United States Patent [19]

Sawyer

[11] 3,983,782

[45] Oct. 5, 1976

[54] AMMUNITION LOADING SYSTEM

[75] Inventor: Quentan Theodore Sawyer, Milton, Vt.

[73] Assignee: General Electric Company, Burlington, Vt.

[22] Filed: Feb. 25, 1975

[21] Appl. No.: 552,944

[52] U.S. Cl. ..... 86/48; 89/33 CA; 89/35 R; 42/87

[51] Int. Cl.[2] ..... F42B 39/10; F41F 9/02; F41C 27/00

[58] Field of Search ..... 86/48, 47; 89/33 BB, 89/35 R, 33 CA; 42/87–89; 221/79, 81, 84

[56] References Cited

UNITED STATES PATENTS

| | | | |
|---|---|---|---|
| 323,997 | 8/1885 | Allender | 89/33 CA |
| 504,516 | 9/1893 | Broderick et al. | 89/35 R |
| 2,402,195 | 6/1946 | Woodberry et al. | 86/48 X |
| 2,460,096 | 1/1949 | Lyon | 86/48 |
| 2,778,276 | 1/1957 | Hepperle | 89/155 X |
| 2,820,400 | 1/1958 | O'Brien | 89/33 CA |
| 3,032,907 | 5/1962 | Parker | 42/88 |
| 3,222,989 | 12/1965 | Kamp | 89/155 |
| 3,538,636 | 11/1970 | Roth | 42/87 |
| 3,696,704 | 10/1972 | Backus et al. | 89/33 BB X |

*Primary Examiner*—David H. Brown
*Attorney, Agent, or Firm*—Bailin L. Kuch

[57] ABSTRACT

An ammunition loading system includes one or more clips, each holding a plurality of rounds, and a clip stripper/loader unit for progressively and at a uniform rate removing rounds from the clips and inserting each round at a uniform pitch into a conveyor.

20 Claims, 6 Drawing Figures

V
44
42
84
86
74
V

AMMUNITION LOADING SYSTEM

The invention herein described was made in the course of a contract with the Department of the Air Force.

BACKGROUND OF THE INVENTION

1. Field of the Invention

This invention relates to a clip for holding a plurality of cartridges and a mechanism for rapidly and progressively unloading or loading one or more of such clips in sequence.

2. Prior Art

Fixed ammunition in calibers of 20mm and larger is conventionally shipped by the manufacturer with a cardboard tube around each round, and a plurality of rounds, in layers, in a box. Conventionally, each round is manually and individually removed from the box, stripped of its cardboard tube and inserted into an ammunition handling system. The system might be a link in a belt of links, of the type early shown by F. L. Bailey in U.S. Pat. No. 173,751 issued Feb. 22, 1876, and C. M. Broderick et al. in U.S. Pat. No. 504,516 issued Sept. 5, 1893. Alternatively, the system might be a drum system of the type shown by E. W. Panicci et al. in U.S. Pat. No. 2,993,415 issued July 25, 1961, and L. F. Backus et al. in U.S. Pat. No. 3,696,704 issued Oct. 10, 1972.

Since the modern drum system associated with Gatling gun type aircraft weapon systems may hold over 1,000 rounds, a rather lengthy process is involved in manually, individually loading just one weapon system.

BRIEF DESCRIPTION OF THE INVENTION

Accordingly, it is an object of this invention to provide a system for rapidly removing cartridges from their shipping box and for loading them into the weapon ammunition handling system, while still utilizing the conventional shipping box. Another object is to provide such a system which will provide the reverse function of loading cases or cartridges into clips.

A feature of this invention is the provision of an ammunition loading system comprising of one or more clips, each holding a plurality of rounds and a clip stripper/loader unit for progressively and at a uniform rate removing rounds from the clips and inserting each round at a uniform pitch into a conveyor. Additionally, the system is symmetrically reversible so that the conveyor can provide rounds or cases to the unit which will load them into the clips.

The invention may be further appreciated when contrasted with a link belt stripping system of the type shown, for example, by F. P. Reed in U.S. Pat. No. 3,311,021 issued Mar. 28, 1967; a strippable cartridge clip for pistols of the type shown, for example, by W. H. B. Smith at Page 205 in "Small Arms of the World", Stackpole Company, eighth edition, 1966; and the end held clip for guns shown, for example, by G. M. Chinn at Page 282 in "The Machine Gun", Vol. IV, Department of the Navy, 1955.

BRIEF DESCRIPTION OF THE DRAWING

These and other objects, features, and advantages of the invention will be apparent from the following specification thereof taken in conjunction with the accompanying drawing in which.

DESCRIPTION OF THE DRAWING

Figure 1:
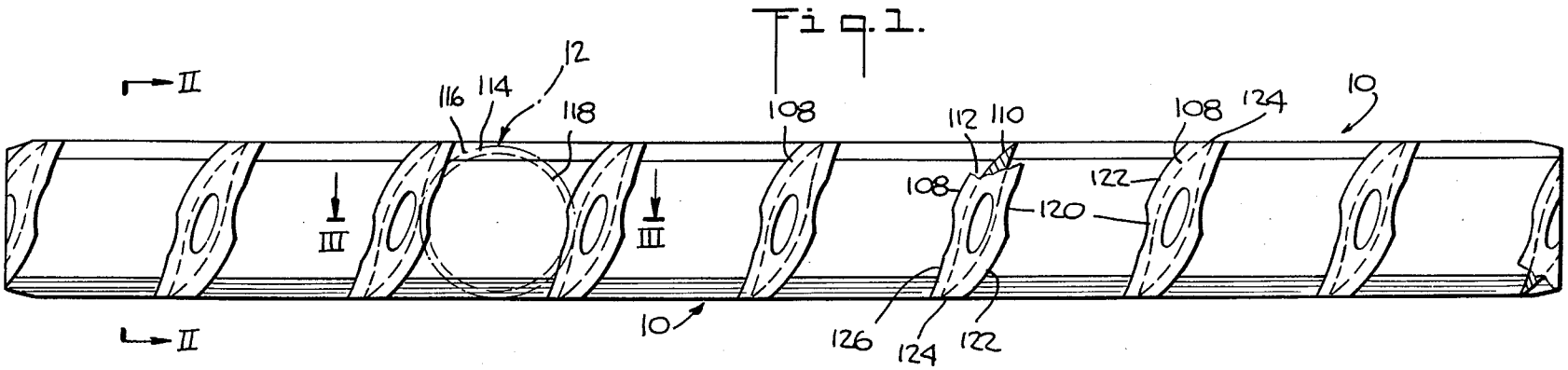
FIG. 1 is a plan view of a clip embodying this invention.
Figure 3:
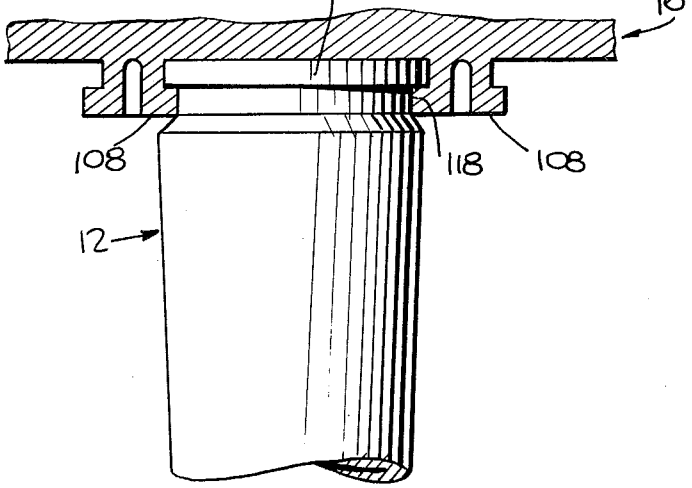
FIG. 3 is a view in elevation in cross-section taken along plane III—III of the clip of FIG. 1.
Figure 2:
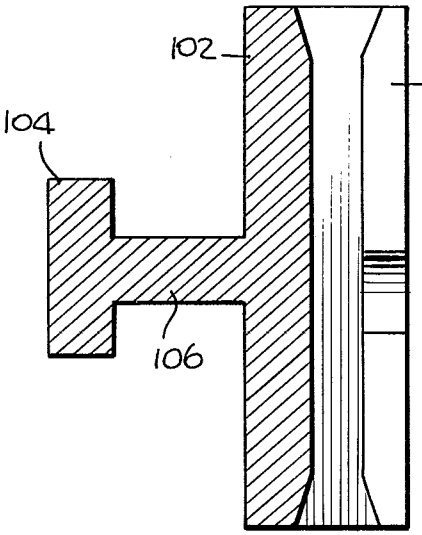
FIG. 2 is an end view in cross-section taken along plane II—II of the clip of FIG. 1.

The ammunition clip 10 shown is adapted to hold eight rounds 12 by their respective extractor disks 14, protecting their respective primers. The width of the clip is substantially equal to the diameter of the extractor disk. Each of the rounds may be disposed in a cardboard tube (not shown). The rounds are packed in a conventional ammunition box (not shown) in layers of eight rounds each. The cardboard tubes may be adhered to each other to form a honeycomb, so that when a clip is removed from the box it carries out with it the eight rounds without their respective cardboard tubes.

The stripper/loader unit 20 comprises a housing 22 in which is disposed an endless conveyor system 24 of the type shown by R. G. Kirkpatrick is U.S. Pat. No. 3,429,221 issued Feb. 25, 1969. The system includes an endless chain of conveyor elements 26 each having a pair of feet constrained by a pair of spaced apart, channel-shaped guides 28, and driven, at each end of the chain, by a respective conveyor sprocket 30, which is fixed onto a shaft 32, which is journaled through the housing.

A guide way 42 of substantially T-shaped cross-section is formed in the left side wall 44, to receive the clip and to pass it through and out of the housing. A right hand inner guide surface 46 is provided by a plate 52 for the projectile of each cartridge carried by the clip 10.

A guide way 60 is provided in the left side wall 44, adjacent to the eject sprocket 38, to receive and to support the bases of cartridge cases. A right hand inner guide surface 62 is provided by a plate 64, and a right hand outer guide surface 66 is provided by a ridge 68 in the right side portion of the housing, to support any projectile carried by a cartridge case passing around the eject sprocket 38. A suitable receptacle 70, shown in dotted line, such as a length of cartridge chuting, may be attached to the housing to receive cartridge cases with projectiles; e.g., misfired rounds, from the eject sprocket. An aperture 72 is provided in the housing to pass out cartridge cases that lack projectiles; e.g., fired cases. In the absence of a projectile which would be supported by the guide surface 66, the case, after it leaves the eject sprocket 38, tilts out of the guide way 60 and falls through the aperture 72 into a suitable catch receptacle, not shown.

A rod 74 is fixed to the housing. An outer pair of gate members 76 are journaled on the rod 74 and have respective elongated slots 78. An inner pair of gate members 80 are journaled on the rod 74 and have respective elongated slots 82. A rod 84 has its ends captured in a pair of slots 86 in the left and right side walls of the housing, and passes through the slots 78 and 82. A handle 88 has a distal bore which captures the rod 84 and has a medial, elongated slot in which the rod 74 rides. The handle also has two opposed clips 90 and 92, which respectively and alternatively snap onto the rod 74. In the handle-in position shown in FIG. 6, the clip 90 is snapped onto the rod 74, and the gate members 76 and 80 are cammed by the rod 84 in their respective slots to the swung-in position shown. In this position, cartridges (or cases) are handed by the stripping sprocket 34 to the upper run of the conveyor 24 as it passes around the sprocket 30; while the lower run of the conveyor 24 passes cartridges (or cases) to the eject sprocket 38. In the handle-out position, the clip 92 is snapped onto the rod 74, and the gate members 76 and 80 are cammed by the rod 84 in their respective slots to the swung-out position. In this position, cartridges (or cases) in the lower run of the conveyor are passed around the conveyor sprocket 32 to the upper run of the conveyor. In the handle-in position, with the sprockets and conveyor drive reversed, cartridges (or cases) in the upper run of the conveyor are handed to the stripping sprocket 34 and reset into a clip 10.

The clip 10 is an elongated, beam-like member having a first plate 102, a second plate 104, and a cross-web 106. The plate 104 may be narrower than the plate 102. A plurality of plates 108 are spaced from the plate 102 by respective webs 110. Each plate 108 overhangs its web 110 by a uniform margin 112 which is equal to or slightly greater than the margin 114 of the extractor disk 14 of the cartridge case 12 beyond the diameter of the neck 118 of the extractor groove of the case. The margin 112 is reducd at its midsection by an arcuate concavity 120. Mutually opposed concavities 120 on adjacent plates 108 define a circle having a diameter equal to or slightly greater than the diameter of the neck 118 of the extractor groove. The clip may be made of a material having a slight resilient characteristic such as polypropylene, MIL-P-46109, type 2, class 2. Thus, the neck 118 may be snapped between and held by opposed concavities and, subsequently, may be snapped out therefrom. The trailing edge 122 of the plate 108 from the concavity 120 to the side 124 is a developed curve surface. The curve is developed from the path the round takes as it is handed in to the stripping sprocket 34 while its neck 118 is driving the clip forward one rounds-pitch. The leading edge 126 of the plate 108 from the concavity 120 to the side 124 is also a developed curve surface. The curve is developed from the path the round takes as it is handed off by the stripping sprocket 34 while its neck 118 is driving the clip backward one rounds-pitch.

The clip terminates at each end through the center of a respective plate 108 and web 110, so that the clips may be fed end-to-end into the unit 20, at all times maintaining a constant pitch between consecutive rounds. The clip is symmetrical so that either end may be used as the lead end.

Figure 4:
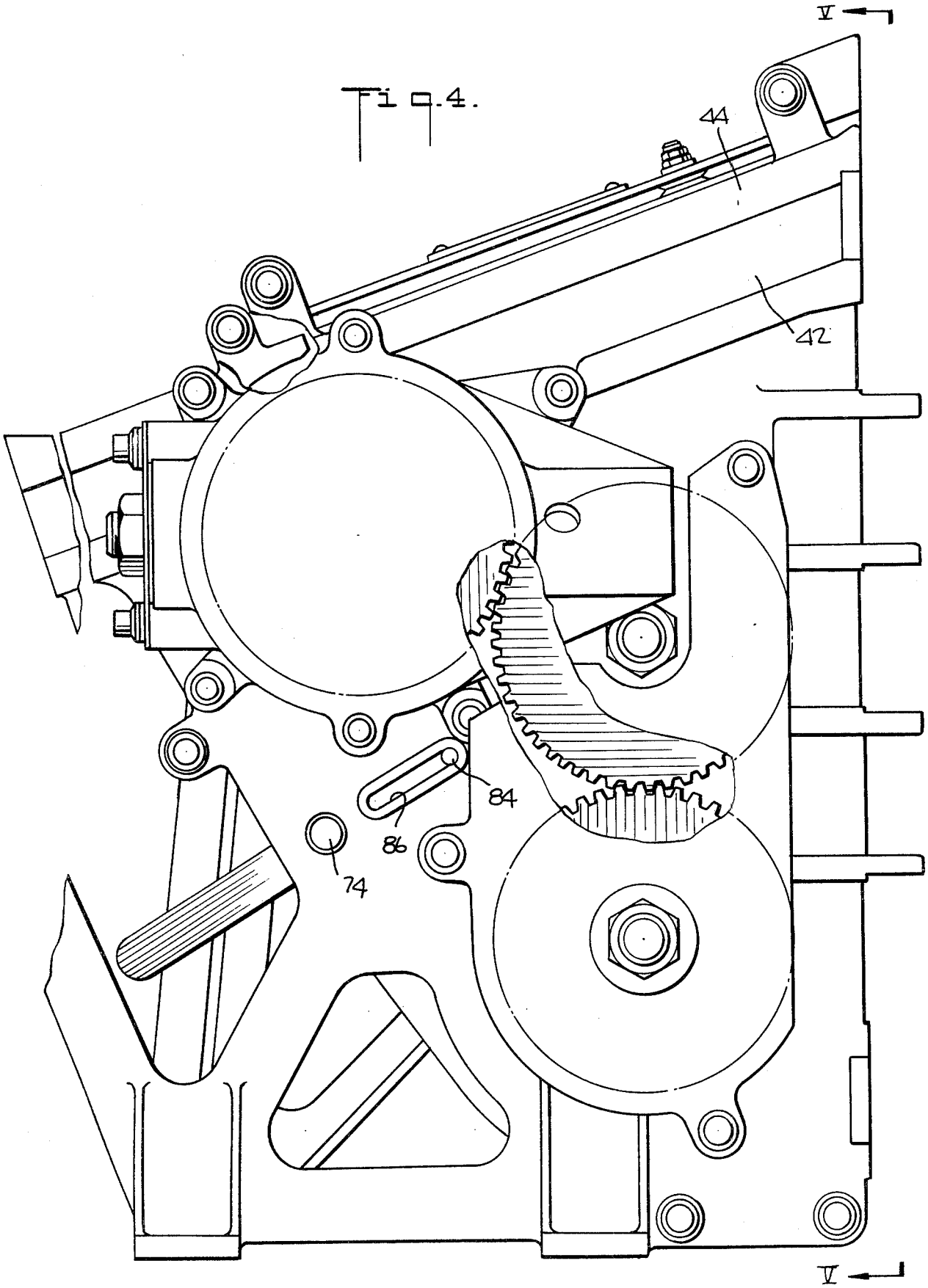
FIG. 4 is a view in elevation of a clip stripping/loading unit embodying this invention.
Figure 5:
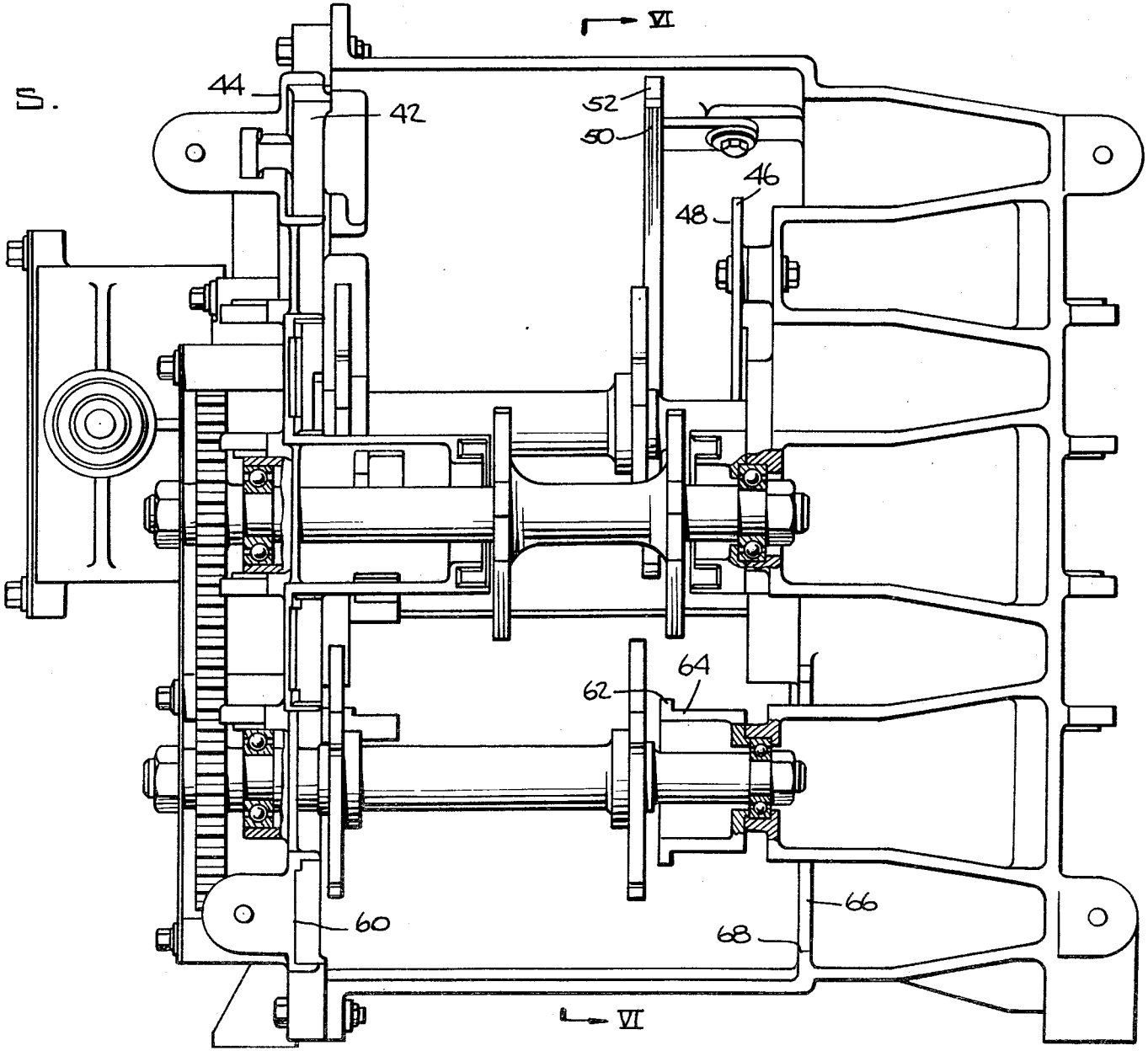
FIG. 5 is an end view in cross-section taken along plane V—V of the unit of FIG. 4.
Figure 6:
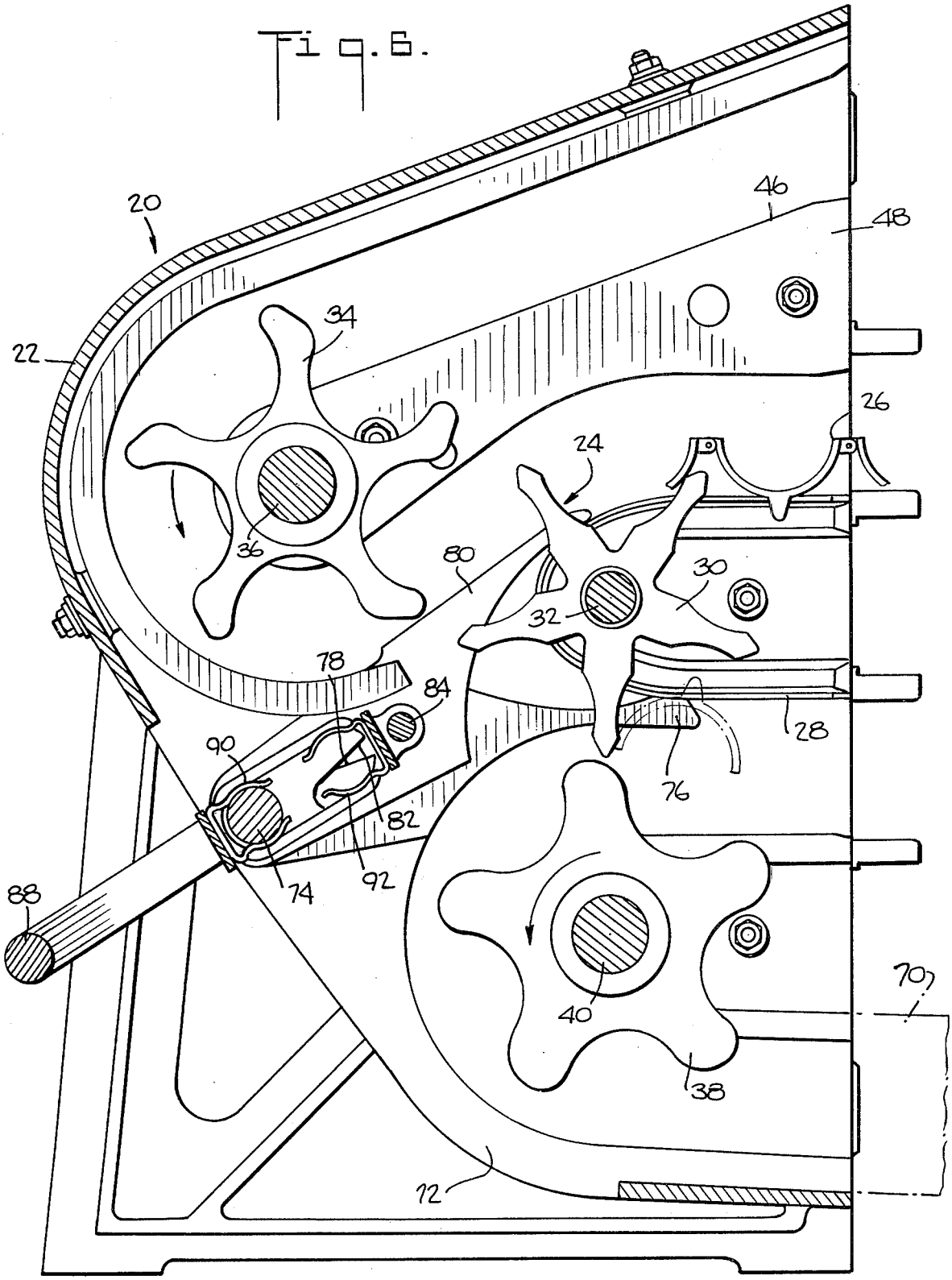
FIG. 6 is a view in elevation in cross-section taken along plane VI—VI of the unit of FIG. 5.

Each of the shafts 32, 36 and 40 is coupled, as shown in FIGS. 4 and 5, to a respective gear, so that during the unloading of clips, as shown in FIG. 6, the shafts 36 and 40 will be driven counterclockwise, and the shaft 32 will be driven clockwise; and while reloading clips, the direction of rotation of each these shafts will be reversed.

What is claimed:

1. An ammunition handling system comprising:

a clip for holding a plurality of cases of rounds of ammunition;

an endless articulated conveyor system having a plurality of serially jointed together elements, each element for receiving a case of a round of ammunition; and transfer means for stripping cases serially from said clip and for transfering each such case in sequence to a respective element in said conveyor system.

2. A system according to claim 1 wherein:

said transfer means also serves for withdrawing cases serially from said conveyor system and for inserting each such case in sequence into said clip.

3. A system according to claim 1 wherein:

said transfer means also serves for withdrawing cases serially from said conveyor system and for transferring cases having projectiles along a first path and for transferring cases not having projectiles along a second path which diverges from said first path.

4. A system according to claim 1 wherein:

said clip comprises an elongated first plate, an elongated second plate spaced from said first plate, an elongated web joining said first and second plates into a T-shaped cross-section, and a plurality of third plates, each plate joined to and spaced from said first plate by a respective web, and extending substantially transversely across said first plate, immediately adjacent third plates defining therebetween a cavity for receiving and to snap-lock therebetween the base of a case of a round of ammunition.

5. A system according to claim 4 wherein: each base of a case has an extractor groove, and wherein said adjacent third plates include diametrically opposed annular concavities, mutually opposed concavities defining said cavity as a circular recess adapted to closely receive therein the neck of the extractor groove of the case, each third plate being spaced from said first plate by a distance adapted to closely receive therebetween the extractor disk of the case.

6. A system according to claim 5 wherein:

said third plates are made of a material having a resilient characteristic whereby the neck of the extractor groove may be snapped between and from said mutually opposed concavities.

7. A system according to claim 6 wherein:

each of said clips terminates at each end in the center of a third plate, whereby two clips may be disposed end-to-end to provide a train of third plates of uniform configuration and pitch.

8. A system according to claim 7 wherein:

said transfer unit includes a sprocket means; and guide means for receiving clips in a serial train and for translating said clips serially past said sprocket means, said sprocket means being disposed to engage each case held by said clips in sequence and to progressively withdraw such case from said clip as said clip passes said sprocket means.

9. A system according to claim 8 wherein:

a respective cam surface is provided on the periphery of each of said third plates, such that as said sprocket means withdraws a case from between adjacent third plates, that case is thereby driven against the respective adjacent cam surface to translate said clip past said sprocket means.

10. A system according to claim 9 further including:

means for driving said sprocket means and said endless conveyor system in synchronism.

11. A system according to claim 10 wherein:

said driving means is adapted to drive said sprocket means and said endless conveyor system in first respective directions for transferring cases from said clip to said conveyor system, and in second, opposite to said first, respective directions for transferring cases from said conveyor system to said clip.

12. A system according to claim 11 wherein:

a respective additional cam surface is provided on the periphery of each of said third plates, such that as said sprocket means inserts a case between adjacent third plates, that case is thereby driven against the respective adjacent additional cam surface to translate said clip past said sprocket means.

13. A system according to claim 1 wherein:

said clip comprises an elongated first plate, a plurality of second plates, each plate spaced from said first plate by a respective web, and extending substantially transversely across said first plate, immediately adjacent second plates being adapted to snap-lock therebetween the base of a case of a round of ammunition.

14. An ammunition handling system comprising:

a clip, for holding a plurality of cases of rounds of ammunition, comprising:

an elongated first plate, an elongated second plate spaced from said first plate, an elongated web joining said first and second plates into a T-shaped cross-section, and a plurality of third plates; each plate joined to and spaced from said first plate by a respective web, and extending substantially transversely across said first plate, immediately adjacent third plates defining therebetween a cavity for receiving and for snap-locking therebetween the base of a case of a round of ammunition;

an endless conveyor system having a plurality of elements, each element for receiving a case of a round of ammunition; and transfer means for stripping cases serially from said clip and for transferring each such case in sequence to a respective element in said conveyor system.

15. An ammunition handling system comprising:

a clip, for holding a plurality of cases of rounds ammunition, comprising:

an elongated first plate, a plurality of second plates, each plate joined to and spaced from said first plate by a respective web, and extending substantially transversely across said first plate, immediately adjacent second plates defining therebetween a cavity for receiving and for snap-locking therebetween the base of a case of a round of ammunition;

an endless conveyor system having a plurality of elements, each element for receiving a case of a round of ammunition; and transfer means for stripping cases serially from said clip and for transferring each such case in sequence to a respective element in said conveyor system.

16. An ammunition handling system comprising:

a clip for holding a plurality of rounds of ammunition;

an endless articulated conveyor system having a plurality of jointed together elements, each element for receiving a round of ammunition; and transfer means for stripping rounds serially from said clip and for transferring each such round in sequence to a respective element in said conveyor system, including sprocket means; and guide means for receiving clips in a serial train and for translating said clips serially past said sprocket means, said sprocket means being disposed to engage each round held by said clips in sequence and to progressively withdraw each such round from said clip as said clip passes said sprocket means.

17. An ammunition handling system comprising:

a clip for holding a plurality of rounds of ammunition;

an endless conveyor system having a plurality of elements, each element for receiving a round of ammunition;

transfer means for stripping rounds serially from said clip and for transferring each such round in sequence to a respective element in said conveyor system and vice versa, including sprocket means, and guide means for receiving clips in a serial train and for translating said clips serially past said sprocket means, said sprocket means being disposed to engage each round held by said clips in sequence and to progressively withdraw such round from said clip as said clip passes said sprocket means; and means for driving said sprocket means and said endless conveyor system in synchronism in first respective directions for transferring rounds from said clip to said conveyor system, and in second, opposite to said first, respective directions for transferring rounds, or remainders thereof, from said conveyor system to said clip.

18. An ammunition handling system comprising a clip for holding a plurality of rounds of ammunition;

an endless conveyor system having a plurality of elements, each element for receiving a round of ammunition;

transfer means for stripping rounds serially from said clip and for transferring each such round in sequence to a respective element in said conveyor including sprocket means, and guide means for receiving clips in a serial train and for translating said clips serially past said sprocket means, said sprocket means being disposed to engage each round held by said clips in sequence and to progressively withdraw such round from said clip as said clip passes said sprocket means;

said clip including a plurality of mutually spaced apart cam surfaces, one for each round, having a function such that as said sprocket means withdraws a round from said clip, that round is driven against the respective cam surface to translate said clip past said sprocket means.

19. An ammunition handling system according to claim 17, wherein:

said clip additionally includes a first plurality of mutually spaced apart cam surfaces, one for each round, having a function such that as said sprocket means withdraws a round from said clip, that round is driven against the respective cam surface to translate said clip in a first direction past said sprocket means, and a second plurality of mutually spaced apart cam surfaces, one for each round, having a function such that as said sprocket means tranfers a round, or remainder thereof, to said clip, that round, or remainder thereof is driven against the respective cam surface to translate said clip in a second direction, opposite to said first direction, past said sprocket means.

20. A clip for a plurality of rounds of ammunition, each round having a cartridge case with an extractor disk defining an extractor recess comprising:

an elongated first plate, a plurality of second plates, each plate joined to and spaced from said first plate by a respective web, and extending substantially transversely across said first plate, the peripheries of immediately adjacent second plates defining therebetween a cavity for receiving and for snap-locking therebetween the extractor recess of a case, said clip terminating at each end in the center of a second plate, whereby two clips may be disposed end-to-end to provide a train of second plates of uniform configuration and pitch.

* * * * *